US005165811A

United States Patent [19]

MacLeod

[11] Patent Number: 5,165,811

[45] Date of Patent: Nov. 24, 1992

[54] CLEANING APPARATUS

[76] Inventor: Hugh W. MacLeod, 2244 E. Pender St., Vancouver, B.C., Canada

[21] Appl. No.: 685,870

[22] Filed: Apr. 16, 1991

[51] Int. Cl.[5] ..... A47L 1/08; A47L 1/15

[52] U.S. Cl. ..... 401/23; 401/37; 401/140; 401/186; 401/206; 401/207

[58] Field of Search ..... 401/22, 23, 25, 206, 401/205, 207, 37, 140, 186

[56] References Cited

U.S. PATENT DOCUMENTS

| | | | |
|---|---|---|---|
| 542,906 | 7/1895 | Urban et al. | 401/23 |
| 844,700 | 2/1907 | Urban | 401/206 |
| 1,255,695 | 2/1918 | Blumenthal | 401/207 |
| 1,630,463 | 5/1927 | Barlow | 401/23 |
| 1,883,664 | 10/1932 | Fleischman | 401/207 |
| 2,201,236 | 5/1940 | Leopold | 401/205 |
| 3,455,638 | 7/1969 | Braswell | 401/23 |
| 3,590,414 | 7/1971 | Gores | 401/207 X |
| 3,694,097 | 9/1972 | Fedorek | 401/206 |
| 3,737,938 | 6/1973 | Saltzstein | 401/207 X |
| 3,805,990 | 4/1974 | Palaudarias | 401/206 X |
| 4,291,491 | 9/1981 | Maddock | 401/205 X |

FOREIGN PATENT DOCUMENTS

| | | | |
|---|---|---|---|
| 460533 | 10/1913 | France | 401/23 |
| 422208 | 1/1935 | United Kingdom | 401/23 |

*Primary Examiner*—Steven A. Bratlie
*Attorney, Agent, or Firm*—Leon Gilden

[57] ABSTRACT

An elongate handle mounts a support plate, the support plate mounting a head member thereon. The head member includes a removably mounted sponge head securable to a forward face of the head member, with a flexible polymeric arcuate plate mounted removably to a rear face of the head member. A modification of the invention includes the handle formed with a refillable reservoir, wherein the handle is deformable to effect pressurizing of the reservoir and effect directing of fluid through a supply conduit to a further supply conduit, thereafter directing cleaning fluid to the sponge through a series of valve plugs directed through the further supply conduit.

1 Claim, 5 Drawing Sheets

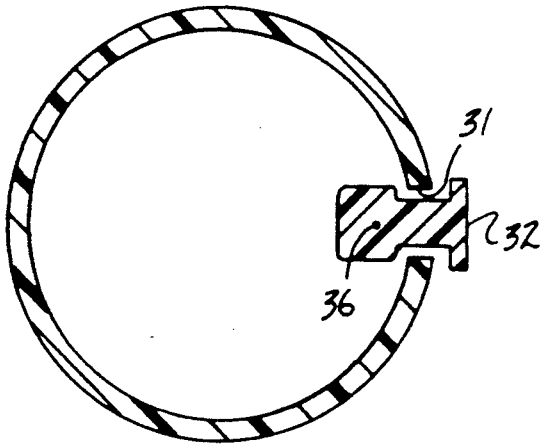
FIG. 4
FIG. 5
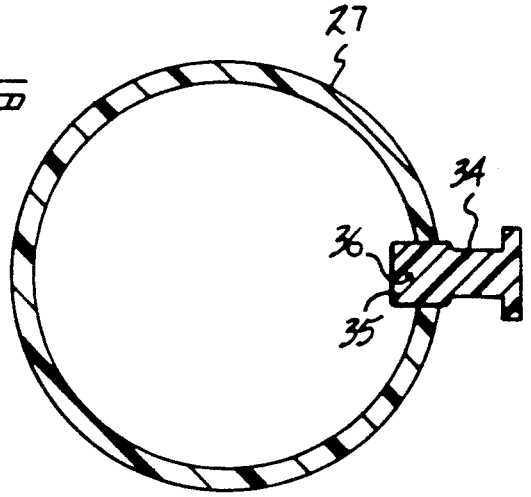
FIG. 6
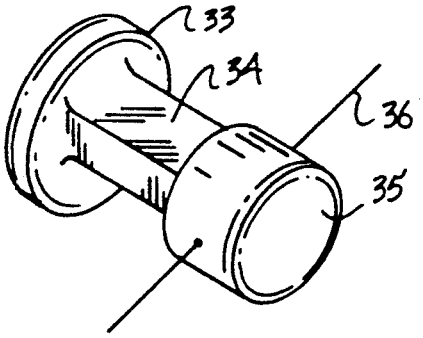

CLEANING APPARATUS

BACKGROUND OF THE INVENTION

1. Field of the Invention

The field of invention relates to cleaning apparatus, and more particularly pertains to a new and improved cleaning apparatus wherein the same is arranged for the cleaning and subsequent wiping of fluid from various surfaces.

2. Description of the Prior Art

Various cleaning apparatus has been utilized in the prior art. Such prior art has typically been in the form of conventional mop structure to provide cleaning of various surfaces. Such apparatus is exemplified in U.S. Pat. No. 4,817,228 to Vonmeyer wherein a sponge member utilizes a pneumatic pump directed through a handle to effect directing of fluid to an underlying sponge head.

U.S. Pat. No. 4,077,672 to Clark sets forth a method of making a sponge mop wherein the apparatus illustrates the securement of a backing and support flange to a sponge head.

U.S. Pat. No. 4,908,901 to Torres sets forth a sponge head for mounting to various support handles.

U.S. Pat. No. 4,831,677 to Morrison sets forth a sponge mop utilizing a slidable tubular member to effect the compressing and cleaning of a sponge to extract liquid therefrom.

As such, it may be appreciated that there continues to be a need for a new and improved cleaning apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cleaning apparatus now present in the prior art, the present invention provides a cleaning apparatus wherein the same provides for mounting of a sponge head and wiper assembly to an upper terminal end of a handle member to effect cleaning of various surfaces, wherein the sponge member is arranged for removable mounting relative to a support head. As such, the general purpose of the present invention, which will be described subsequently in greater detail, is to provide a new and improved cleaning apparatus which has all the advantages of the prior art cleaning apparatus and none of the disadvantages.

To attain this, the present invention provides an elongate handle mounting a support plate, the support plate mounting a head member thereon. The head member includes a removably mounted sponge head securable to a forward face of the head member, with a flexible polymeric arcuate plate mounted removably to a rear face of the head member. A modification of the invention includes the handle formed with a refillable reservoir, wherein the handle is deformable to effect pressurizing of the reservoir and effect directing of fluid through a supply conduit to a further supply conduit, thereafter directing cleaning fluid to the sponge through a series of valve plugs directed through the further supply conduit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cleaning apparatus which has all the advantages of the prior art cleaning apparatus and none of the disadvantages.

It is another object of the present invention to provide a new and improved cleaning apparatus which may be easily and efficiently manufactured and marketed.

It is a further object of the present invention to provide a new and improved cleaning apparatus which is of a durable and reliable construction.

An even further object of the present invention is to provide a new and improved cleaning apparatus which is susceptible of a low cost of manufacture with regard to both materials and labor, and which accordingly is then susceptible of low prices of sale to the consuming public, thereby making such cleaning apparatus economically available to the buying public.

Still yet another object of the present invention is to provide a new and improved cleaning apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic cross-sectional illustration of a second supply conduit utilized by a modification of the instant invention.

FIG. 5 is an orthographic cross-sectional illustration of a supply conduit utilized by the instant invention, with a valve plug in a closed orientation relative to the conduit.

FIG. 6 is an isometric illustration of the valve plug utilized by the instant invention in association with a spring member.

DESCRIPTION OF THE PREFERRED EMBODIMENT

Figure 1:
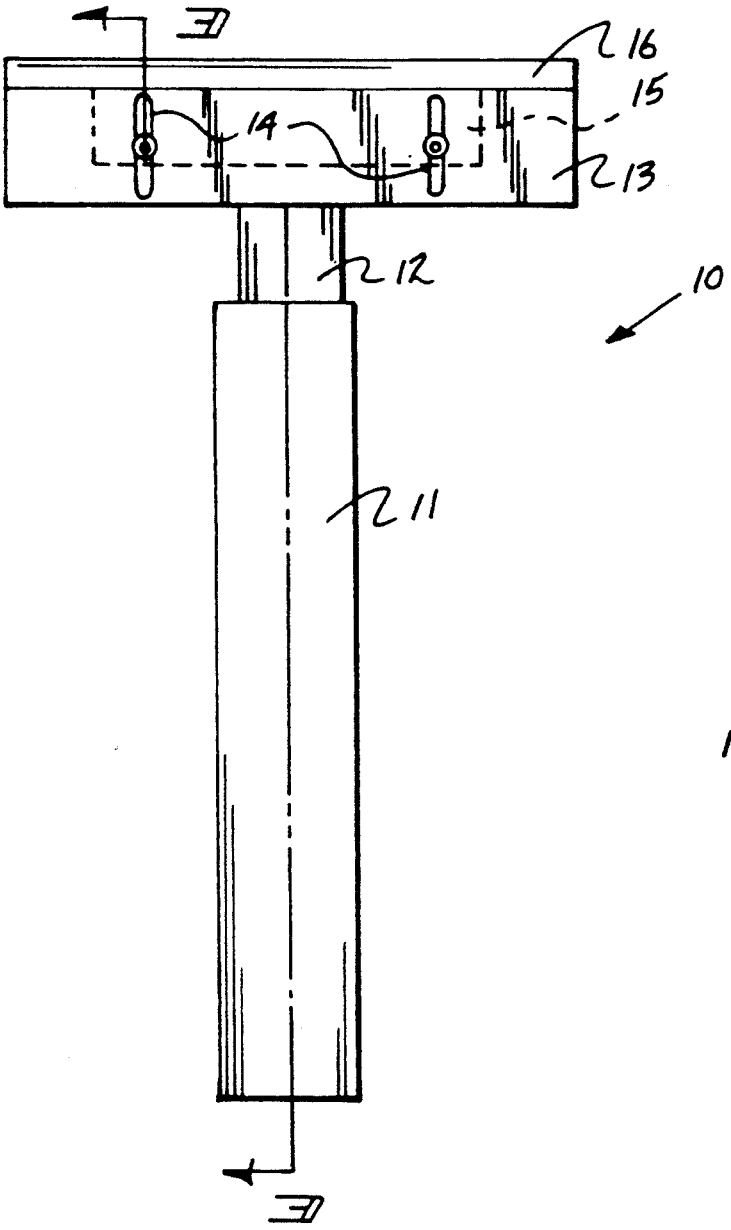
FIG. 1 is an orthographic rear view, taken in elevation, of the instant invention.
Figure 2:
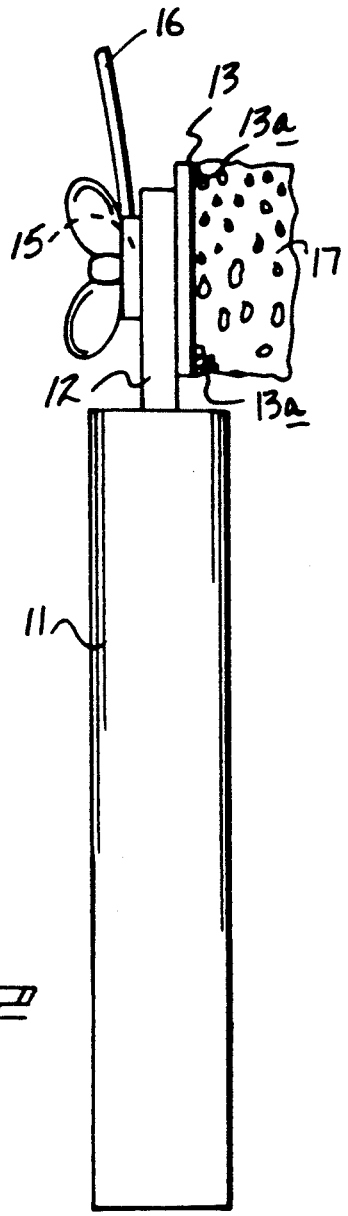
FIG. 2 is an orthographic side view, taken in elevation, of the instant invention.
Figure 3:
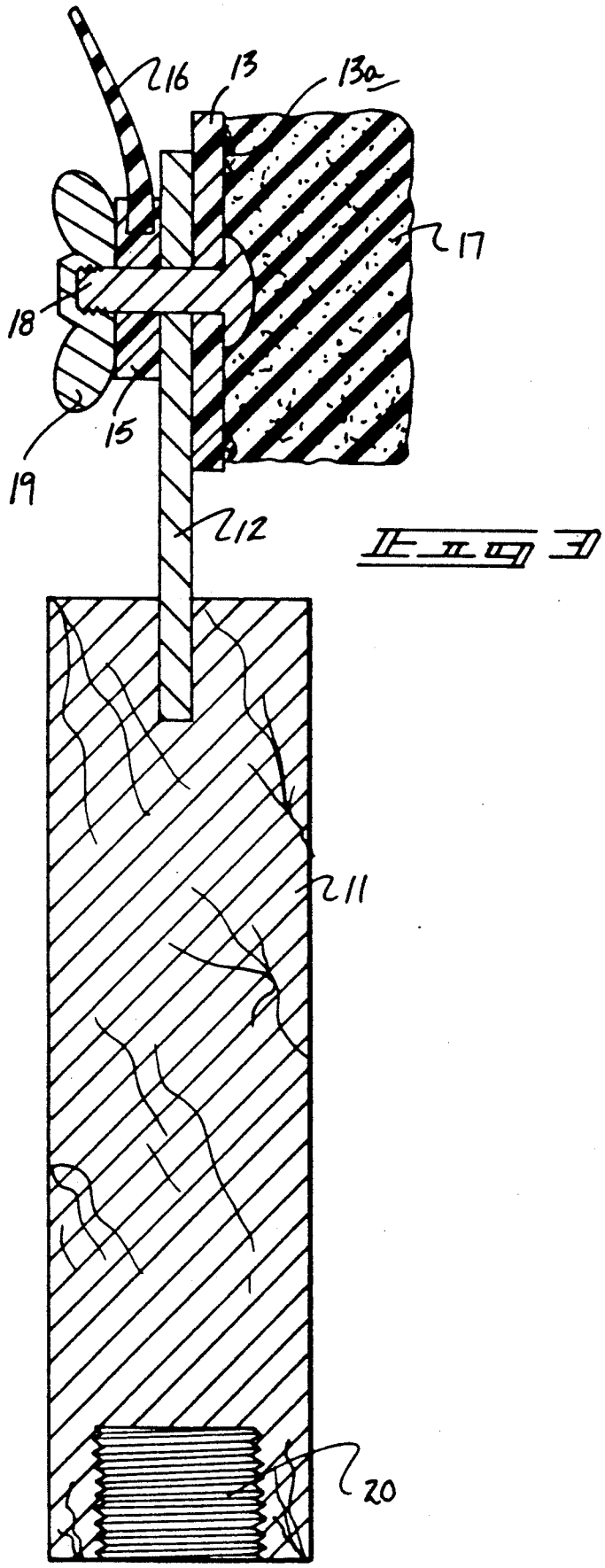
FIG. 3 is an orthographic cross-sectional illustration, taken in elevation, of the instant invention.

With reference now to the drawings, and in particular to FIGS. 1 to 9 thereof, a new and improved cleaning apparatus embodying the principles and concepts of the present invention and generally designated by the reference numerals 10 and 10*a* will be described.

More specifically, the cleaning apparatus 10 of the instant invention essentially comprises an elongate coaxially aligned handle 11 formed with a handle extension shaft 12 coaxially mounted integrally to an upper terminal end of the handle 11. A support head 13 is orthogonally and integrally mounted to an upper terminal end of the extension shaft 12, with the support head 13, as illustrated in FIG. 1, utilizing a plurality of elongate parallel enclosed slots 14 through which a fastener stud 18 is directed. The fastener stud 18 is mounted to a sponge head and secured through a mounting plate 15 that in turn mounts a flexible polymeric arcuate wiper plate 16 that cooperates with the sponge head 17 that is mounted to the support head 13. The sponge head 17 may be mounted to the support head 13 utilizing hook and loop fasteners 13*a* that may be coextensive with or in various longitudinal spaced positions at upper and lower edges of the support head 13. An internally threaded socket 20 is directed through a lower terminal end of the handle 11 coaxially aligned with the handle 11 to receive an extension member to permit access to remote portions of a surface to be cleaned, such as walls, windows, and the like. It should be noted that the hook and loop fasteners 13*a* may be utilized in lieu of the fastener studs 18 that may alternatively be fixedly secured to a rear surface of a sponge 17 in securing of the sponge head 17 to the support head 13.

Figure 7:
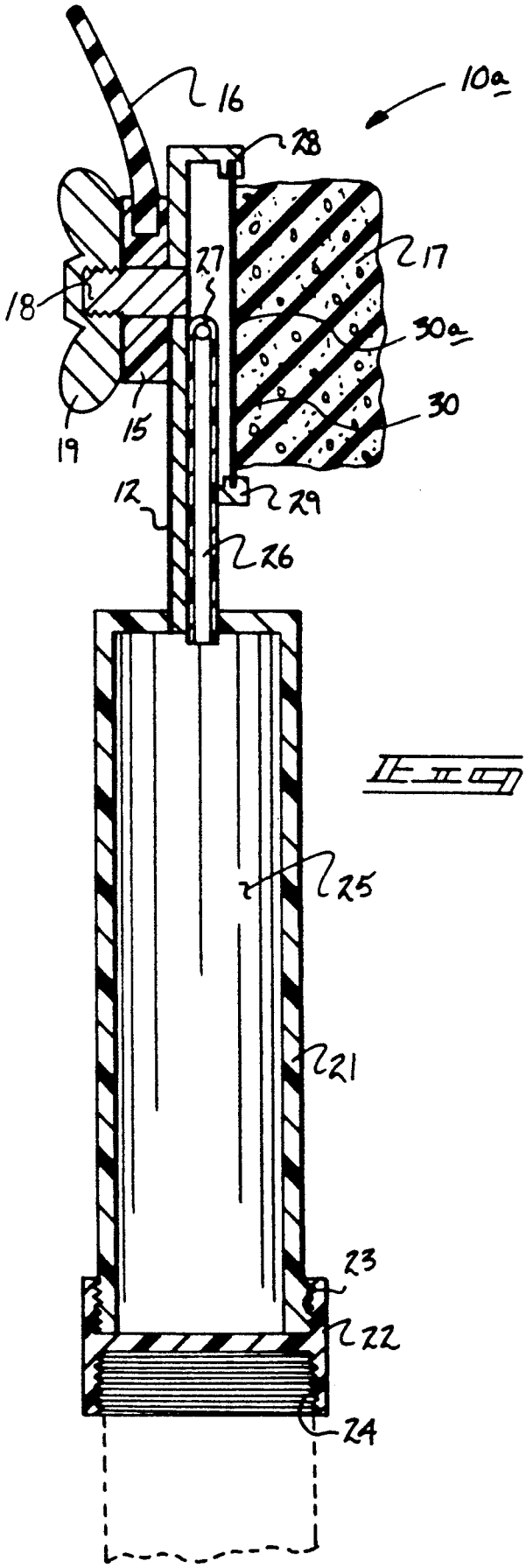
FIG. 7 is an orthographic cross-sectional illustration of a modification of the instant invention.
Figure 8:
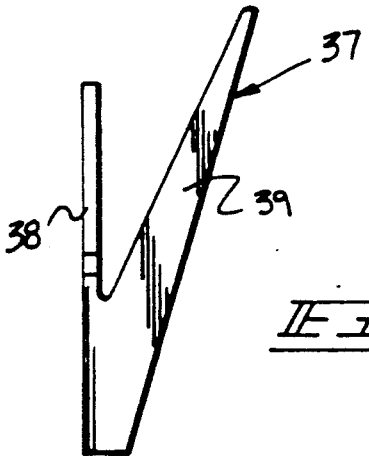
FIG. 8 is an orthographic end view of a wiper plate utilized by the instant invention.
Figure 9:
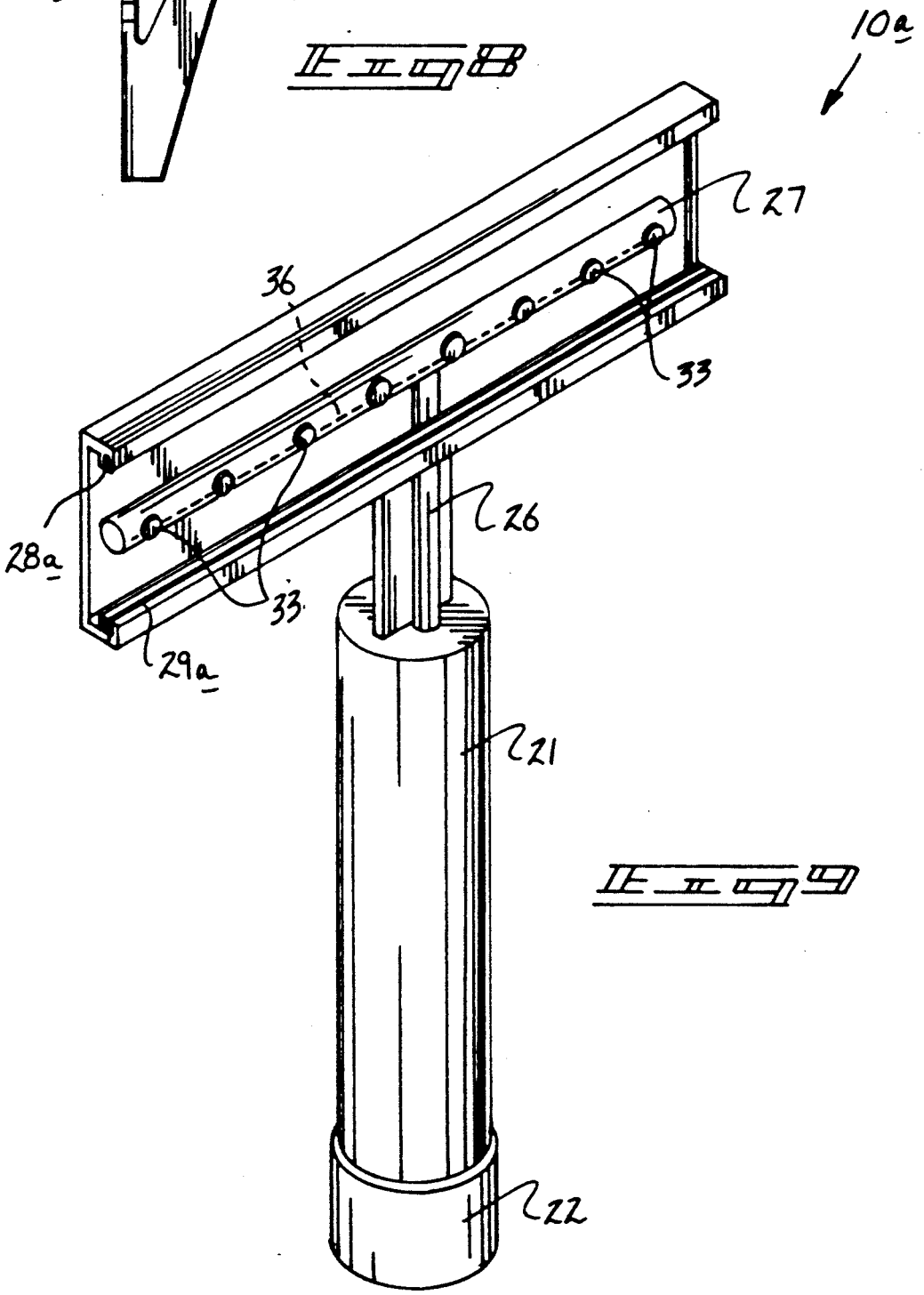
FIG. 9 is an isometric illustration of a modification of the modification of the instant invention.

FIGS. 4–9 illustrate a modified cleaning apparatus 10*a* utilizing a tubular handle 21 that is manually deformable and whose lower terminal end is closed by a lower cap member 22 that is removably mounted to a lower threaded end of the tubular handle 21. The cap member 22 includes an upper threaded socket 23 to receive the tubular handle 21 therewithin, and a lower threaded socket 24 to receive an extension handle, as illustrated in phantom in FIG. 7. The extension shaft 12 of the modified apparatus 10*a* includes an upper flange 28 and a lower flange 29. The upper and lower flanges 28 and 29 are in spaced parallel relationship to a forward surface of the extension shaft or plate 12, with the upper and lower flanges 28 and 29 including confronting upper and lower flange slots 28*a* and 29*a* respectively spaced apart a predetermined spacing. A sponge plate 30 defined by a height equal to the predetermined spacing is receivable slidably within the upper and lower slots 28*a* and 29*a*. The sponge plate 30 includes a series of apertures 30*a* directed therethrough in alignment with various valve plugs 32. The valve plugs 32 are reciprocatably mounted within a second supply conduit 27 that is coextensive with the forward surface of the forward face of the extension shaft 12 and positioned medially thereof. The second conduit 27 is in fluid communication with the first fluid supply conduit 26 that is directed from the second supply conduit 27 into the reservoir cavity 25. Valve plugs 32 are reciprocatably mounted, as illustrated in FIGS. 4, 5, and 7 within the second conduit openings 31. The valve plugs 32 each include a head 33, a shank 34, and a cylinder 35 substantially equal to a first diameter defined by a first diameter of each second conduit opening 31. An elongate bow spring 36 normally biases the shank 34 of each valve plug 32 into a first position, as illustrated in FIG. 5, plugging and preventing fluid flow from within the second conduit 27. When the sponge head 17 is compressed, the heads 33 are deflected interiorly permitting fluid flow about the shank 34 between the shank 34 and each of the second conduit openings 31 to direct fluid flow from the reservoir 25 into the sponge head 17. If desired, the sponge head 17 may be slidably removed from within the upper and lower flange slots 28*a* and 29*a*, wherein a "V" shaped wiper blade member 37 is provided, wherein the "V" shaped wiper member includes an apertured mounting plate 38 to permit directing of fluid through associated apertures within the plate 38 onto an interior surface of a wiper leg 39 that is mounted at an acute included angle between the mounting plate 38 and wiper blade 39. In this manner, application of cleaning of a sponge head and subsequent wiping utilizing the wiper leg 39 is provided.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cleaning apparatus, comprising in combination,
   an elongate coaxially aligned handle, the handle including a handle upper terminal end and a handle lower terminal end, the handle upper terminal end including an extension plate fixedly and coaxially mounted to the handle upper terminal end, and
   a support head orthogonally and integrally mounted to an upper terminal end of the extension plate, and
   a flexible polymeric wiper blade selectively mounted to the extension plate, and a sponge head selectively mounted to the support head, and the handle lower terminal end including a lower internally threaded socket to receive an extension shaft therewithin, and wherein the handle is hollow and defines a cavity therewithin, and the lower internally threaded socket is formed within a cap member, the cap member includes an upper internally threaded socket threadedly securable to the handle to permit replenishment of fluid within the cavity, and first fluid supply conduit projecting into the cavity and mounted to the extension plate and extending into the support head from the extension plate, and a second supply conduit in fluid communication with the first fluid supply conduit and mounted to a forward surface of the support head and positioned medially of a forward face of the support head, and wherein the support includes an upper flange and a lower flange, wherein each upper and lower flange is in a spaced parallel relationship relative to the forward face of the support head, and the upper flange and lower flange each include a respective upper slot and a lower slot, the upper slot and the lower slot are in confronting coextensive relationship relative to one another and arranged in a parallel relationship, and the sponge head includes an apertured sponge plate, wherein the apertured sponge plate is slidably receivable within the upper slot and the lower slot, and wherein the second supply conduit includes a series of conduit openings directed therethrough, and each conduit opening includes a valve plug reciprocatably mounted therewithin, wherein each valve plug is positionable from a first position effecting sealing of each opening to a second position permitting fluid flow through each opening, and wherein each valve plug includes a valve plug head extending exteriorly of the second supply conduit, and a shank mounted to the head, and a cylinder mounted to the shank spaced from the head, and the cylinder is defined by a first diameter substantially equal to a second conduit opening diameter defined by each second conduit opening, and each cylinder is normally biased in the first position to effect closure of an associated second conduit opening, and wherein the sponge plate includes a series of apertures therethrough, each aperture aligned with a respective valve plug, whereupon compression of the sponge head biases each valve plug rearwardly to direct each valve plug into a second position permitting fluid flow from the second supply conduit into the sponge head through each second conduit opening, and further including a wiper member mounting plate receivable within said upper flange slot and lower flange slot when the sponge plate is removed from the support head, and the wiper member mounting plate includes a series of openings directed therethrough and each of the openings positioned above an associated wiper leg, the wiper leg formed of a flexible polymeric material and extending above and forwardly of the wiper member mounting plate defining an acute included angle between the wiper leg and wiper member mounting plate.

* * * * *